US005628610A

United States Patent [19]

Stratman et al.

[11] Patent Number: 5,628,610

[45] Date of Patent: May 13, 1997

[54] COMBINATION OF LIFTING APPARATUS AND BRACKET

[76] Inventors: Daniel R. Stratman; Cletus J. Stratman, both of 3706 Union Rd., St. Louis, Mo. 63125

[21] Appl. No.: 341,407

[22] Filed: Nov. 17, 1994

Related U.S. Application Data

[63] Continuation-in-part of Ser. No. 41,934, Apr. 2, 1993, Pat. No. 5,490,757.

[51] Int. Cl.[6] ..... B66C 1/00

[52] U.S. Cl. ..... 414/680; 254/131; 414/917

[58] Field of Search ..... 414/684.3, 917, 414/685, 680, 589; 254/131

[56] References Cited

U.S. PATENT DOCUMENTS

| | | | |
|---|---|---|---|
| Re. 30,533 | 3/1981 | Dushku | 254/131 X |
| 192,554 | 6/1877 | Winters . | |
| 502,397 | 8/1893 | Emons . | |
| 833,331 | 10/1906 | Michaelis . | |
| 891,988 | 6/1908 | Hardy . | |
| 1,093,405 | 4/1914 | Hallen . | |
| 1,129,494 | 3/1915 | Kelleher . | |
| 1,176,513 | 3/1916 | Bell . | |
| 2,823,551 | 2/1958 | Utz | 74/141.5 |
| 3,756,561 | 9/1973 | Rendelman | 254/4 R |
| 4,799,843 | 1/1989 | Arase et al. | 414/331 |
| 4,824,313 | 4/1989 | Miller | 414/346 |
| 4,902,191 | 2/1990 | Cumbest | 414/685 X |
| 5,090,558 | 2/1992 | Hatouchi | 198/781 |
| 5,106,259 | 4/1992 | Anderson | 414/786 |
| 5,173,011 | 12/1992 | Daniel, Jr. et al. | 405/230 |
| 5,180,275 | 1/1993 | Czech et al. | 414/541 |
| 5,193,828 | 3/1993 | Benvenuti | 280/43.24 |
| 5,199,531 | 4/1993 | Malin | 187/9 R |
| 5,234,197 | 8/1993 | Wurdack | 254/94 |
| 5,261,643 | 11/1993 | Wurdack . | |
| 5,275,390 | 1/1994 | Brennan | 269/68 |
| 5,385,335 | 1/1995 | Wurdack | 254/1 |
| 5,447,386 | 9/1995 | Wurdack | 403/403 |

*Primary Examiner*—Donald W. Underwood
*Attorney, Agent, or Firm*—Heller & Kepler

[57] ABSTRACT

A lifting apparatus preferably for applications in which a floor covering is to be removed and/or installed, has a lever arm and support that provide portions of two interconnected linkages. An interchangeable bracket is raised and lowered by the lifting apparatus. The bracket is provided with single-sided and double-sided portions that insert into a partition member to raise the partition when the bracket is raised by the lifting apparatus. A rachet arm is provided by a spring-biased stop member and a serrated portion. The rachet allows the lifting assembly to support the weight of the partition without constant attention, thereby allowing the workers to perform either the removal or installation of a floor covering without an inordinate amount of partition movement.

21 Claims, 12 Drawing Sheets

COMBINATION OF LIFTING APPARATUS AND BRACKET

This is a continuation-in-part of application Ser. No. 08/041,934, filed on Apr. 2, 1993, now U.S. Pat. No. 5,490,757.

BACKGROUND OF THE INVENTION

The present invention relates in general to lifting apparatus and pertains, more particularly to a vertical support and foot supporting a linkage that provides leverage to lift a furniture system, e.g., modular office system that could include walls and furniture. The lifting apparatus of this invention provides an improvement over the conventional crowbar-like equipment used to raise office partitions.

An improved embodiment of the present invention is disclosed that is easier to assemble and to use. The improved embodiment further includes a superior adjustment and lock mechanism for use with the improved lifting apparatus. The improved embodiment of the present invention is further characterized by a pivoting four-bar linkage and a sliding four-bar linkage sharing a common, link arm adjustably supported by a base member.

With the conventional crowbar-like tool it is generally necessary to continually lift and then lower and then move the bar and lift again when installing carpeting either by the yard or in tiles. The same drawback occurs when removing carpeting, tile, or other type or styles of flooring. As the size of the project increases a drawback associated with conventional methods and devices occurs due to the time it takes to complete the project.

Since existing methods and tools for installing flooring generally require the removal of a substantial amount of furniture, a business may have to either shut down during the project to have the furniture, partitions, file cabinets and the like moved twice, once to clear an area for removal and replacing and again to replace the furniture. Another drawback that occurs relates to the additional costs that are not related to the actual flooring project.

Known devices include a moveable fulcrum pin for adjusting the height of a lever supported by a stand or an upright frame supported on a base block, or a base member with outwardly extending wings, or a plurality of vertical standards supported by a base member. Prior devices are used in automobile jacks, window lifting devices, and lifting devices in general. The existing jacks and jacking devices also have a drawback in that they provide a jack that is not particularly suited or adaptable to uses other than those for which the jack is intended.

SUMMARY OF THE INVENTION

Accordingly, it is an object of the present invention to provide a lifting apparatus that is more than simply a jack. With the lifting apparatus of this invention it is possible to install flooring at a rate substantially greater than that previously possible.

Another object of the present invention is to provide a lifting apparatus that is constructed to provide a uniform and repeatable process during flooring installation and thus to provide an expedient method that promotes an efficient use of time and labor.

A further object of the present invention is to provide a lifting apparatus that is adapted for the lifting of modular partitions of any design to thereby provide a substantially universally useable lifting apparatus.

Still another object of the present invention is to provide a lifting apparatus that may be readily used with different furniture arrangements. The lifting apparatus of this invention is preferably provided with a plurality of interchangeable brackets that by simply changing as required will allow use of the lifting apparatus on different styles of office furnishings.

Another object of the present invention is to provide an improved lifting apparatus in which the lifting bracket has two operable sides so that if one side of the bracket is damaged, it can be reversed. Work, therefore, can continue with a minimum amount of delay.

Still a further object of the present invention is to provide a lifting apparatus that is adapted for use to lift and hold a furniture member, particularly a partition member, while flooring is being both removed and installed. The lifting apparatus of this invention is characterized by lifting the furnishing from an offset position so as to allow either removal or replacement of flooring directly underneath the lifted section of the office furnishings.

Another object of the present invention is to provide a lifting apparatus that can be taken to any location along with the appropriate brackets and used as disclosed in the following specification.

Still another object of the present invention is to provide an improved lifting apparatus constructed with a spring-biased locking mechanism for ease of use. The link member arrangement of the improved invention is constructed with a revised and improved arm arrangement to provide for additional mechanical advantage incorporated in a tool that is still easy to manufacture and assemble.

A still further object of the present improved invention is the use of a pivoting four-bar linkage and a sliding four-bar linkage sharing a common, vertically adjustable fourth link.

Another object of the present invention is to provide an improved bracket for use with the lifting tool. The bracket is constructed with engaging and lifting members on more than one side of the bracket to facilitate a quick change of brackets when different style partitions need to be lifted.

To accomplish the foregoing and other objects of this invention there is provided a vertical support and foot supporting a linkage that provides leverage to lift a furniture system, e.g., modular office system that could include walls and furniture. The linkage can be locked in a position with the furniture in a raised position. The bracket is received by complementary openings in the furniture system. The bracket can be changed to allow use of the lifting apparatus with different furniture systems.

In operation, the lifting apparatus is used to lift the furniture in order to replace the carpet with carpet tiles. The off-set of the foot allows the carpet directly beneath the furniture to be replaced without interference from the lifting apparatus. The lifting apparatus is used repeatedly to lift the furniture and replace the carpet until the entire carpet is replaced with carpet tiles.

The lifting apparatus comprises means for supporting a partition at a distance from a work area so as to provide access to a portion of a floor to be covered or uncovered. A lever arrangement provides an advantage to raise and lower the furnishing in the work area. The lever arrangement is part of two linkage assemblies that cooperate to raise the furnishing up and down in a substantially vertical path. An engaging means is provided with engaging portions that are complementary to the furnishing's receiving portions.

The lifting apparatus has means for controlling the height of the engaging means and maintaining the engaging means at a desired position above the work area.

The lifting apparatus of the present invention is preferably adapted for the use of interchangeable brackets. The brackets are removed and replaced as required to provide complementary extensions depending upon the style of furnishing.

In the disclosed embodiment described herein, there is provided a lifting apparatus that comprises two interrelated four-bar linkage arrangements. A release mechanism is carried by a lever member which is part of both of the linkages. Also, in the preferred embodiment the engaging brackets are provided for raising and lowering furnishings that consist of partitions used, for example, in modular office arrangements.

The receiving openings into which the engaging bracket fits are provided by the manufacturer of the partition. The openings are typically used to connect adjacent panels when the partitions are installed, moved, or replaced.

These and other objects and features of the present invention will be better understood and appreciated from the following detailed description of one embodiment thereof, selected for purposes of illustration and shown in the accompanying drawings.

DETAILED DESCRIPTION

Figure 1:
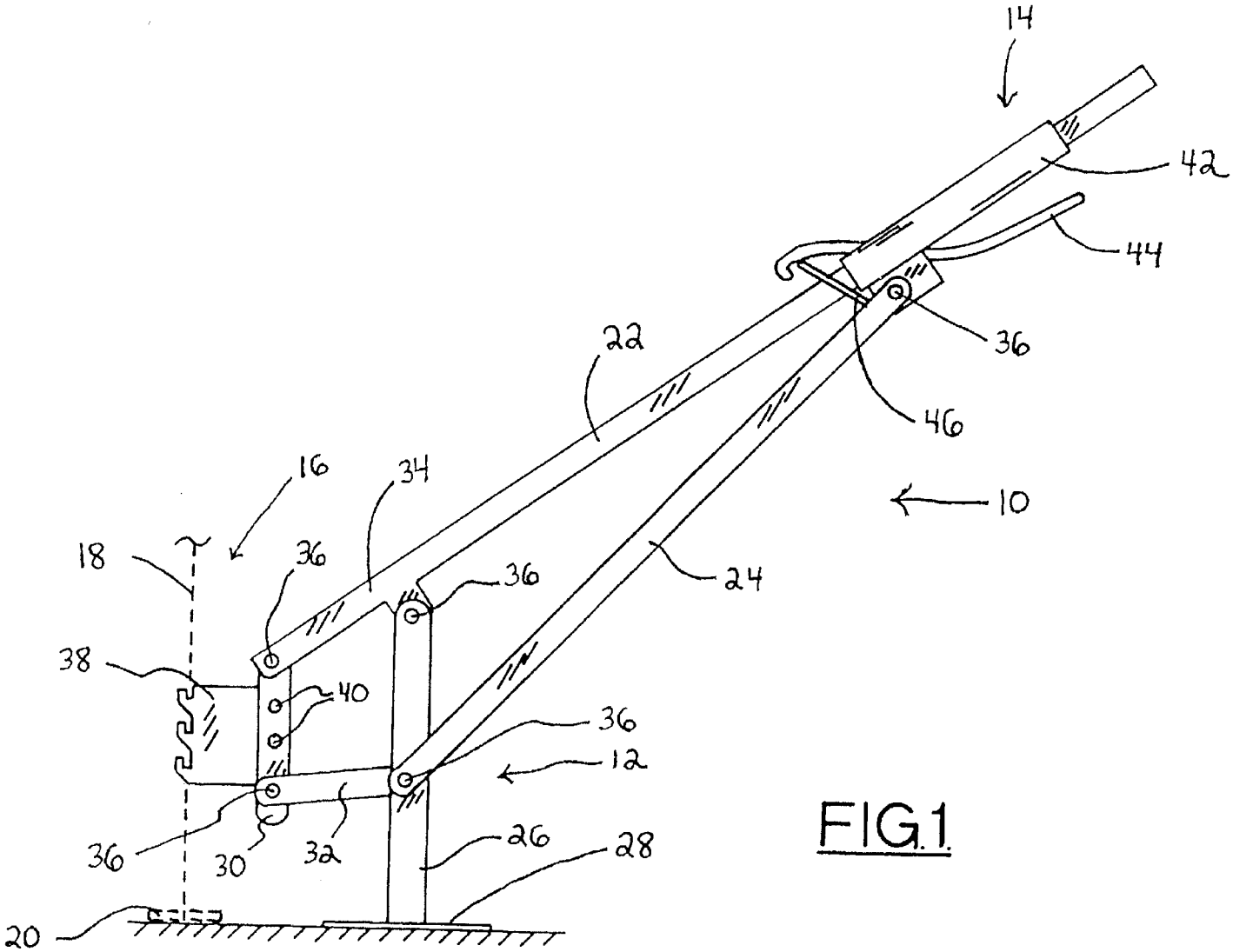
FIG. 1 is a side elevation view of a lifting apparatus constructed in accordance with the present invention shown in a lowered position and a lifting bracket engaging a furnishing member which is shown schematically.
Figure 2:
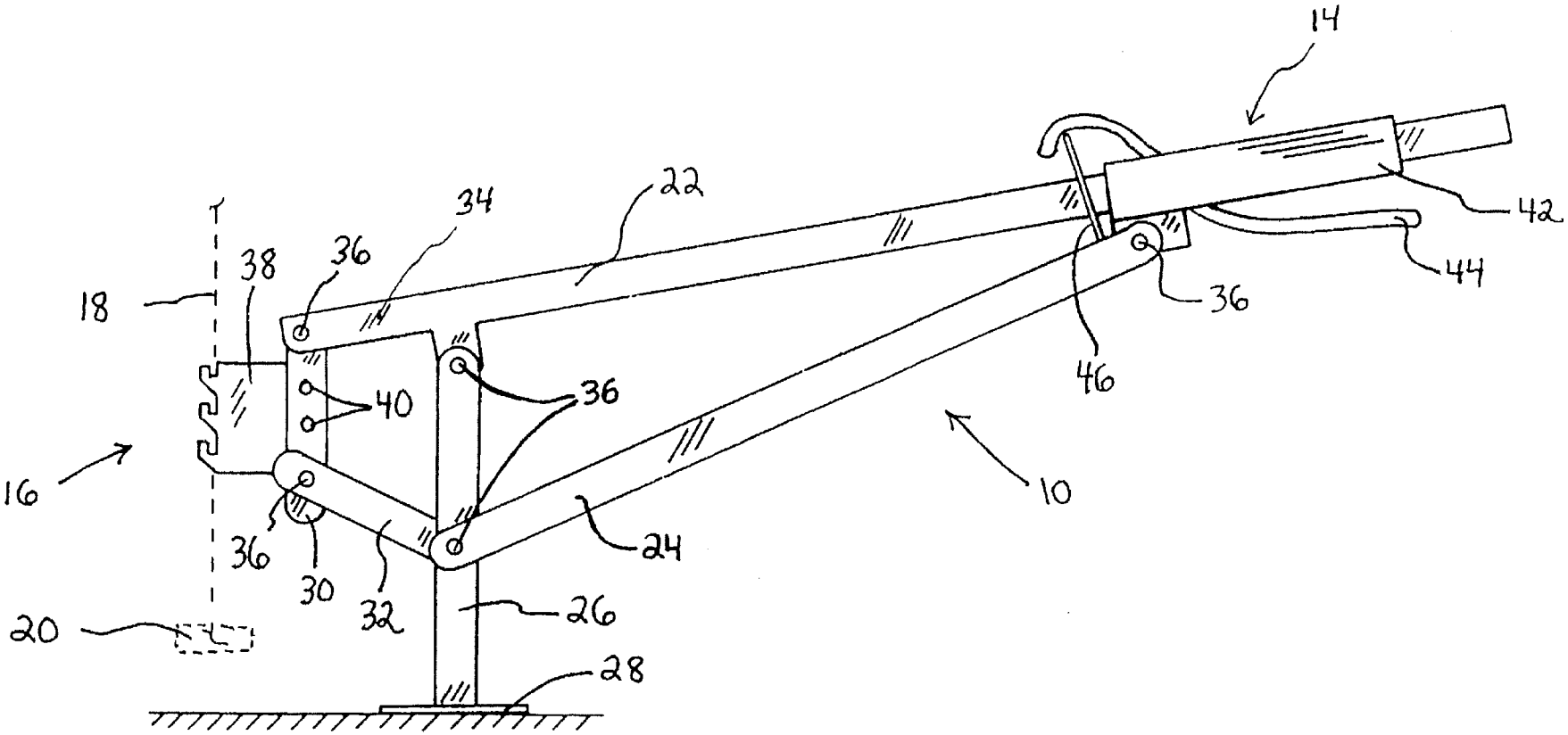
FIG. 2 is another side view of the lifting apparatus depicted in FIG. 1 and shown in a raised position and the lifting bracket engaging the furnishing member.
Figure 3:
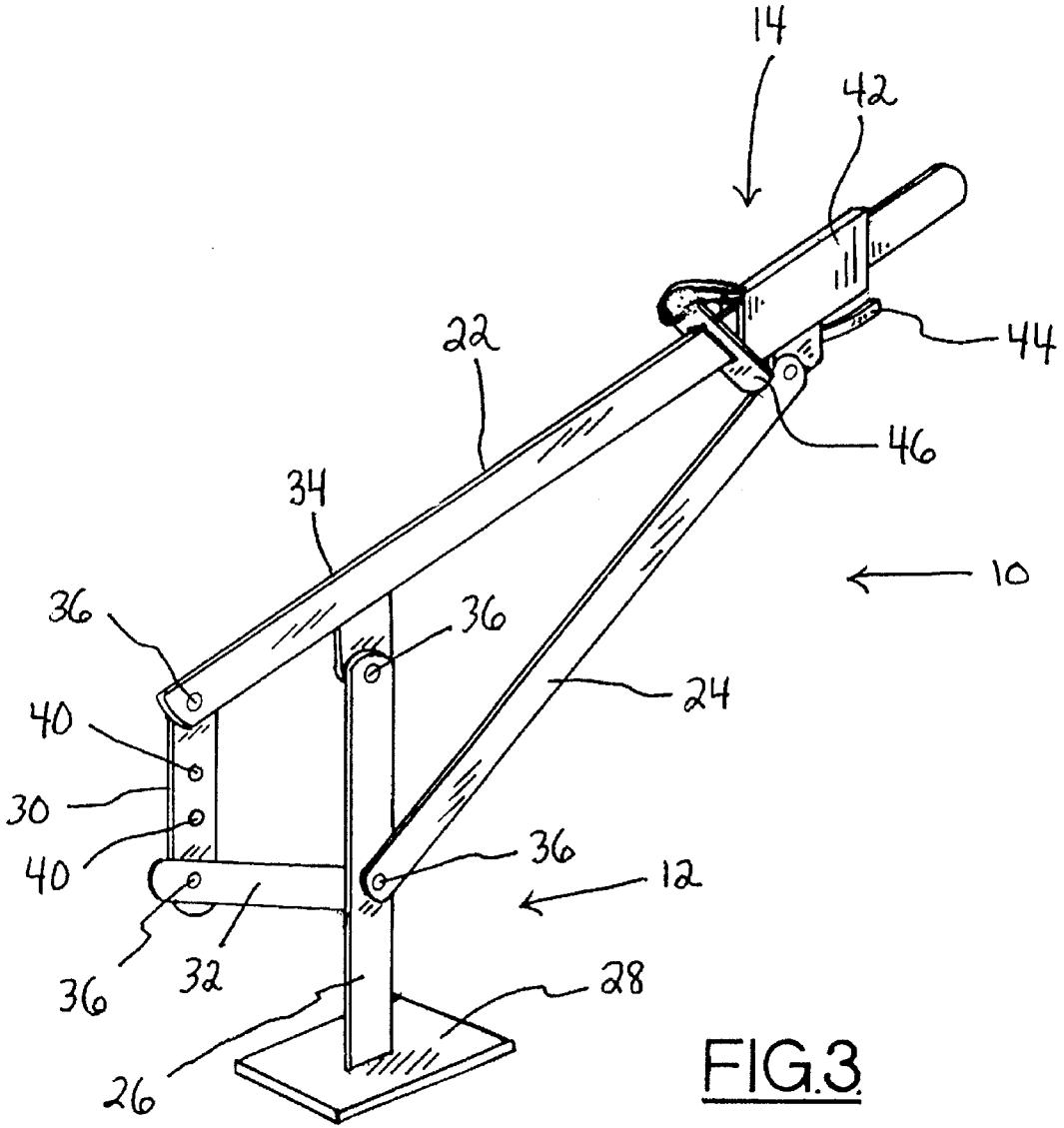
FIG. 3 is a perspective view of the lifting apparatus depicted in the drawings shown with the lifting bracket removed.
Figure 5:
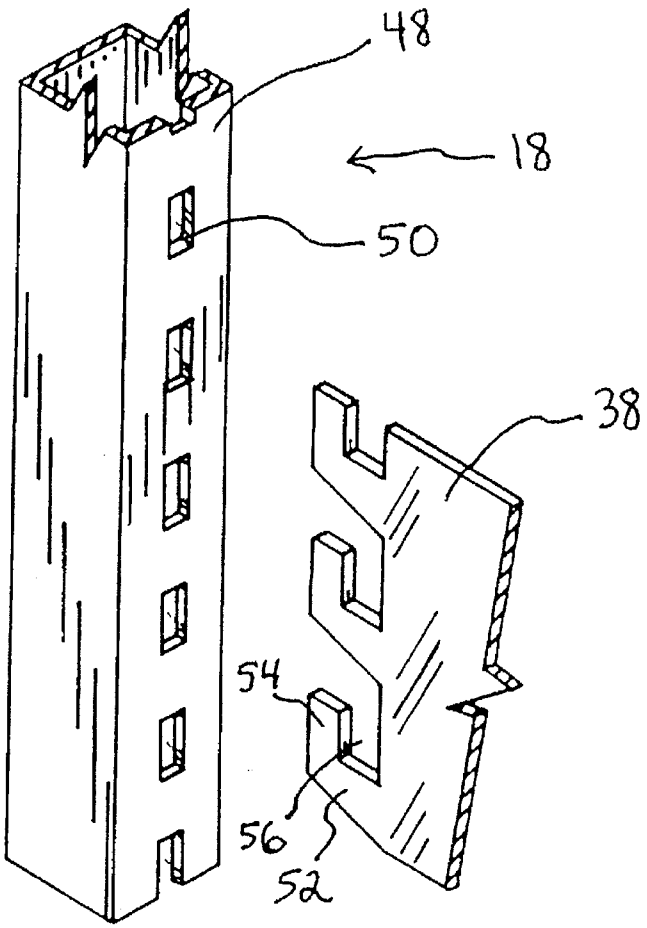
FIG. 5 is another partial perspective view of the lifting bracket and receiving portion of a partition embodiment without the decorative cover.
Figure 4:
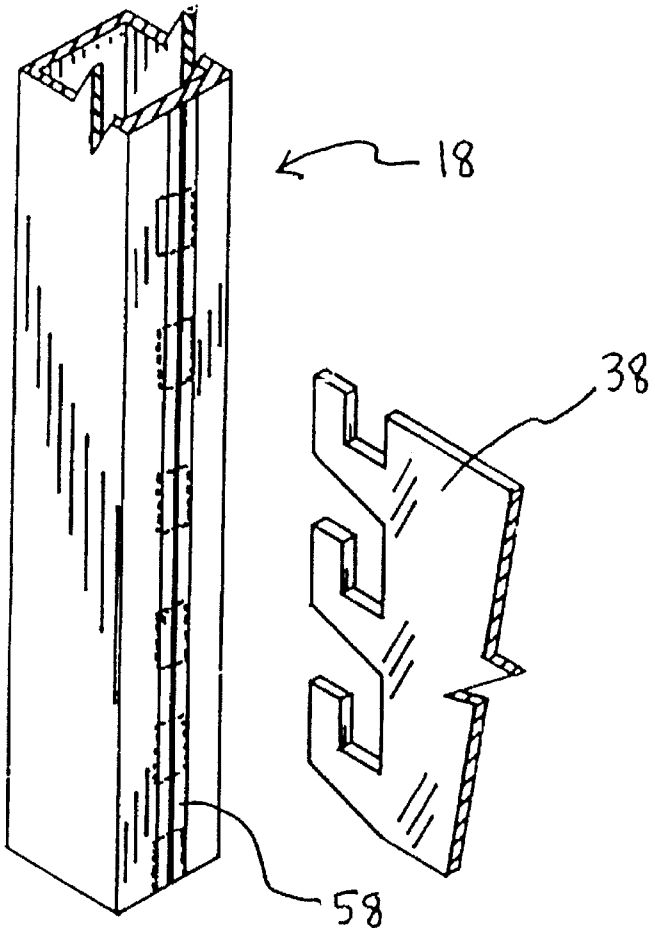
FIG. 4 is a partial perspective view depicting a lifting bracket and a receiving portion of an office partition covered by a decorative cover.

Referring now to the drawings, and more specifically FIGS. 1–5, there is shown a preferred embodiment for the lifting apparatus of this invention. The lifting apparatus is described in connection with an office application to raise and lower office partitions.

The lifting apparatus of the present invention is particularly adapted for providing for the raising and lowering of furnishings, e.g., office partitions, during removal and installation of floor covering and is characterized by an offset support that removes the lifting apparatus from the work area while a locking mechanism holds the partition in place while engaged by a bracket member having an extension or extensions complementary with the partition connection openings used to raise the partition.

The drawings show the lifting apparatus 10 supported on a combination foot and pedestal support 12. The lifting apparatus is maintained in its desired position by a slide and lock mechanism 14. A lifting bracket assembly 16 is used to raise and lower a partition 18 which is illustrated schematically in FIGS. 1 and 2. The partition 18 is typically provided with a foundation of a supporting foot 20 or feet placed at regular intervals along the length of the partition and at the ends and at corners.

The lifting apparatus 10 includes a lever arm 22 that is used to leverage the weight of the partition into a raised position or lower the weight of the partition back towards the floor. The lever arm is generally in an upper position and the lever arm and works in association with a control arm 24 to control the position of the upper lever arm 22.

The support 12 provides a stationary generally vertical link member 26 supported by a support foot 28. This stationary link member is an integral part of both of two interconnected four bar linkages, one that controls the height of the lifting apparatus and the other that raises the partition 18 as a link member 30 is moved vertically up and down parallel to the stationary link member 26. A relatively lower link member 32 and a portion 34 of the upper link member 22 provide the other two members of the four bar linkage. Pivot connections 36 are provided as required.

A lifting bracket 38 is carried by the vertically moving member 30. The lifting bracket is attached for removal and replacement with any other interchangeable bracket. Attachment connections are represented and identified with reference characters 40.

One feature of the lifting apparatus 10 is that it locks in the desired position. A sliding handle assembly 42 slides back and forth on the upper link member 22. A release lever 44 is provided that is biased in an appropriate manner (not shown) so as to hold the sliding assembly and therefore the lifting bracket and anything being lifted at a desired height. In a preferred embodiment the handle is squeezed against the bias to release the sliding assembly and move the member 22 relative to the sliding assembly 42.

In the preferred embodiment illustrated in the drawings another locking feature is provided. A locking plate 46 fits over the member 22 and operates by means of its wobble. If perpendicular to member 22, then plate 46 allows sliding assembly 42 to slide relative to the member 22. Plate 46 wobbles on the member 22. At an angle to member 22 the plate holds the sliding assembly 42. A finger extended from the assembly restrains the plate in proximity to the sliding assembly, while allowing for the wobble effect.

An improved embodiment 110 of the lifting apparatus of the present invention, including modified link arm arrangement and ratchet-type locking assembly and improved brackets are illustrated in FIGS. 6–19. The improved lifting apparatus 110 includes a foot/pedestal support 112 for supporting the apparatus 110.

A slide lock mechanism 114 locks a lifting bracket 140 inserted into a modular panel or partition 18 when the partition 18 is raised off the floor to allow clearance under the partition supporting foot 20. Other possible lifting brackets 116, 118, 120, 121, 123, 125 and 127 are illustrated in the drawings.

The brackets are removable and interchangeable. Thus, the brackets intended for use with the present invention can be changed for use with any suitable partition or easily exchanged for another bracket should one bracket become broken or otherwise unusable.

The improved lifting apparatus 110 includes an upper link and rachet arm 122 supported on an adjustable pedestal 124. A yoke member 126 is attached to the upper link and rachet arm 122 and to a vertical link member 128. The yoke member 126 pivots relative to the adjustable pedestal 124.

The vertical link member 128 is attached to the upper link and rachet arm 122. The vertical link member 128 and the upper link and rachet arm 122 pivot relative each other. The lifting brackets 116, 118, 120, 121, 123, 125 and 127 are supported by an intermediate link member 130.

The intermediate link member 130 is pivotally attached to both the vertical link member 128 and the adjustable pedestal 124 by means of a pivoting four-bar linkage. The pivoting four-bar linkage is created by the yoke 126 and upper link and rachet arm 122, vertical link member 128, the intermediate link member 130 and the lower link member 132.

A sliding four-bar linkage is formed by the yoke 126 and the upper link and rachet arm 122, a lower control arm 133, the sliding lock mechanism 114 and the vertical link member 128. The pivoting four-bar linkage 148 and the sliding four-bar linkage 150 have a common link arm formed by the vertical link member 128 from its pivot connection with the yoke 126 to the common pivot connection with the lower control arm 133 and the lower link member 132.

The upper link and rachet arm 122 includes a serrated surface 138. The serrated surface portion 138 forms serrated surface portion shoulders 152 against which an end 154 of the spring-biased stop member 134 rests when in it is in a biased position, as illustrated in the drawings figures.

A counter-force applied against the spring bias releases the serrated surface portion 138 from the end 154 of the member 134 and allows sliding movement of the slide lock mechanism 114 along the upper link and rachet arm 122, resulting in either raising or lowering any lifting bracket placed on the intermediate link member 130.

In operation, in connection with the partition raising and lowering application previously mentioned to allow the removal or the installation of flooring, the partition 18 typically includes a support member 48 having one or more connection openings 50 for connecting adjacent partitions. Typically, not all of the connections are used unless four partitions (in the case of a square tube support) are connected ninety degrees apart. This leaves one or more groups of connections to be used in concert with the present invention.

In the original embodiment 10 a lifting bracket 52 includes one or more upward directed bracket extensions 54 whose end fits into the complementary connection opening 50. A slot 56 is defined between the extension 54 and the body of the lifting bracket 52.

Figure 6:
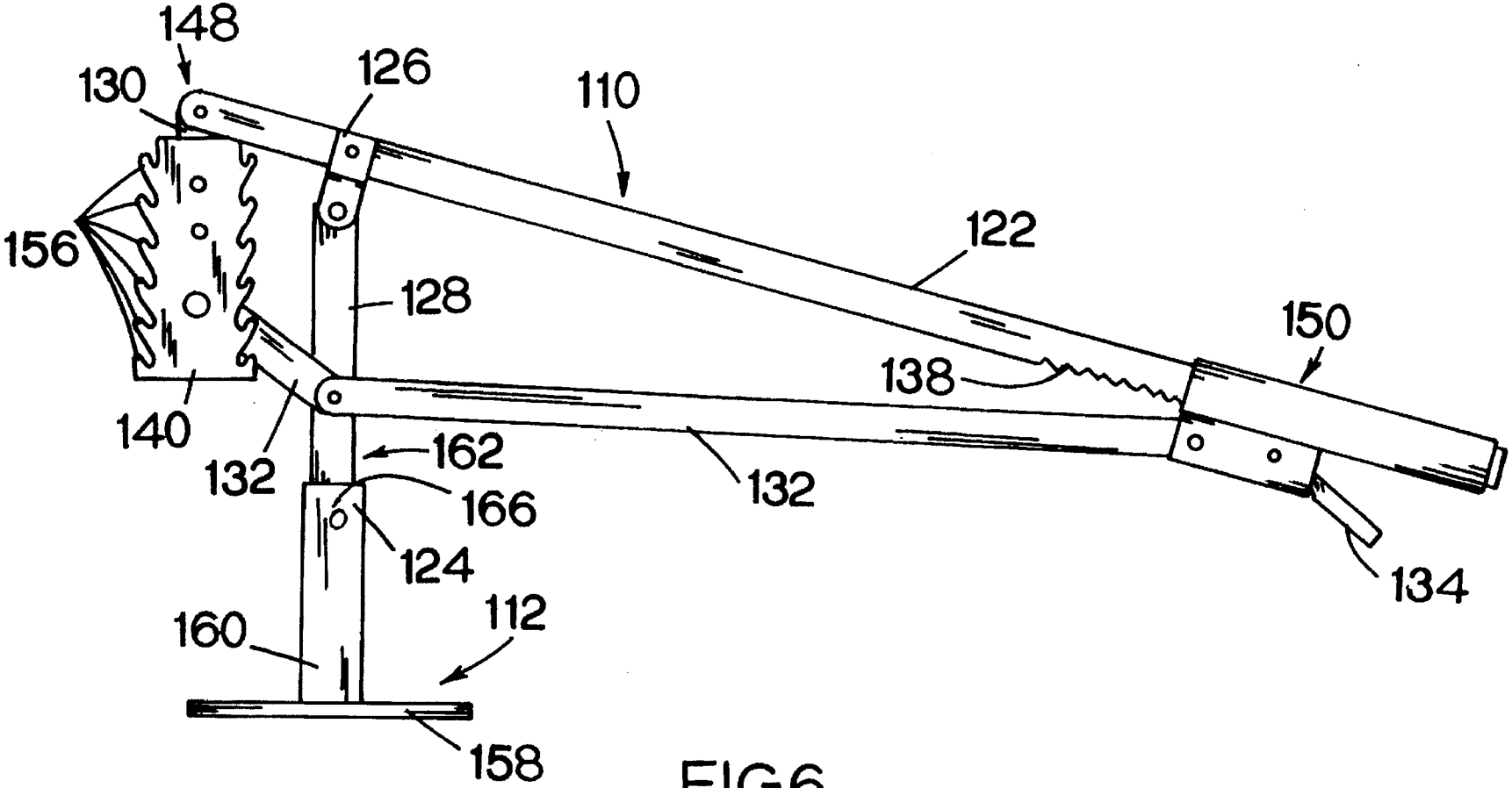
FIG. 6 is a side view of an improved preferred embodiment of the lifting apparatus.
Figure 7:
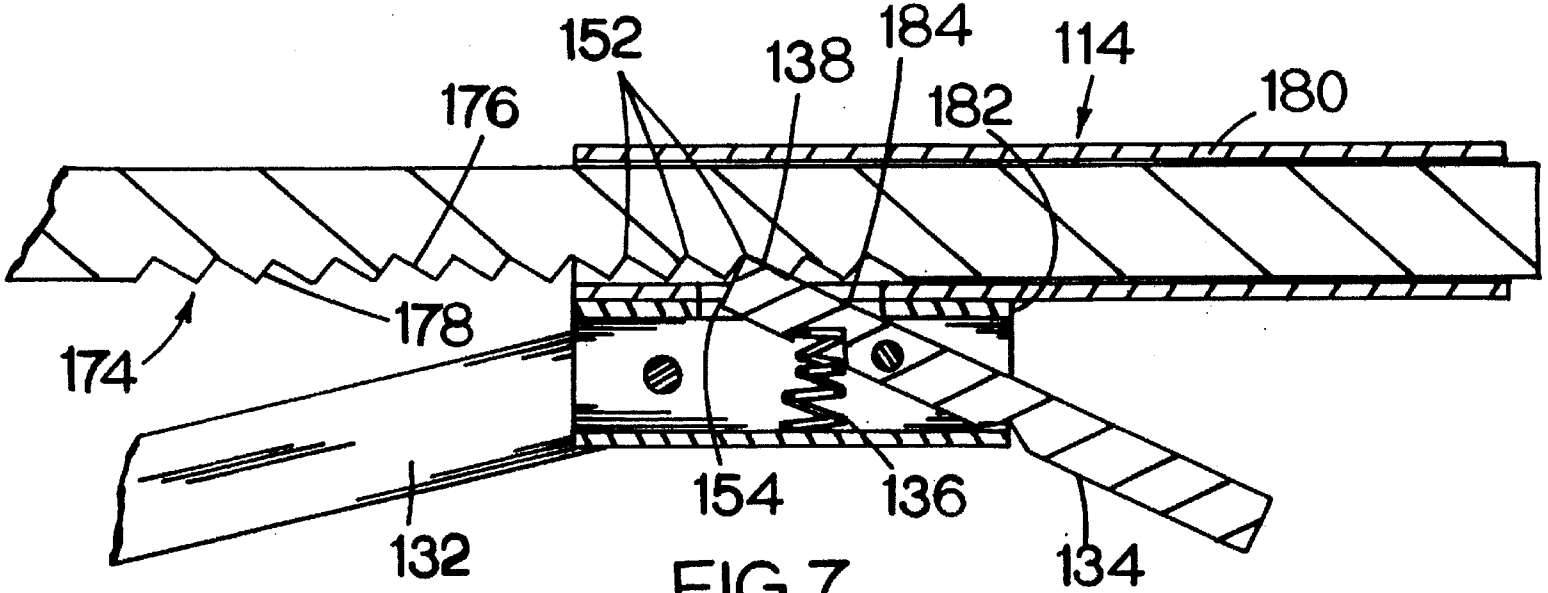
FIG. 7 is a partial sectional view of a sliding assembly illustrating a serrated structure of an upper link and ratchet arm, including a spring-biased stop member.
Figure 8:
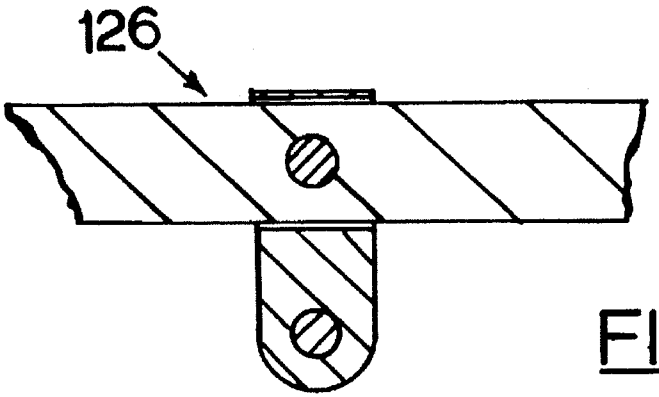
FIG. 8 is a partial section view of a connection between the upper link and ratchet arm and adjustable pedestal.
Figure 9:
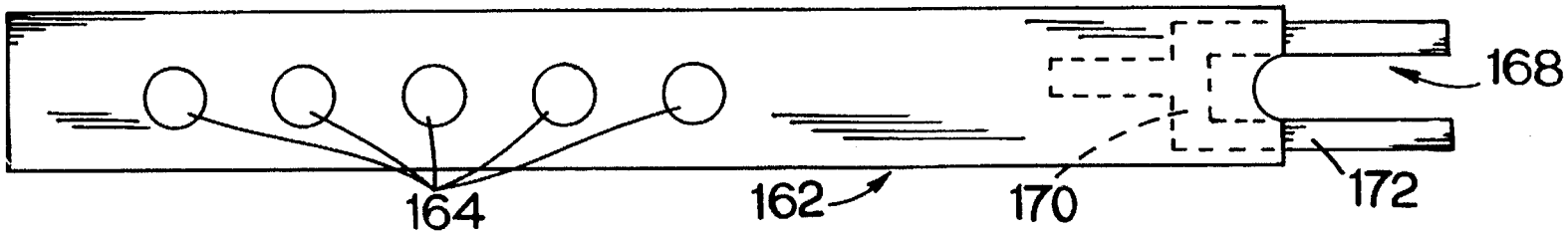
FIG. 9 is another elevational view of the adjustable support member removed from a foot/pedestal support and illustrating locations for adjustment holes not shown in FIG. 6.

In the improved embodiment 110, the lifting bracket 140, as shown in FIG. 6, includes upwardly directed bracket extensions 156 which extend from opposite sides of the bracket 140, which is typical for these brackets with extensions on both sides. In the event of breakage of one or more extensions 156, the bracket 116 can be removed and reversed to utilize the extensions 156 on the opposite side of the bracket 116. It may be desirable to have the extensions 156 to extend from the bracket at an angle.

The improved brackets can be used with the original embodiment of the present invention and the improved invention. A family of brackets is illustrated in FIGS. 10–19 for use with a variety of office furnishings, and more particularly, office-style partitions. The brackets are fashioned for use with particular partition and panel brands currently available.

The lifting apparatus is located and the bracket is inserted into the complementary connection. Squeezing the handle and, if provided, moving plate 46 to an appropriate position allows the handle to be pushed down, and through the cooperative movement of the interconnected linkages allows the upper member 22 to leverage the partition into a raised position.

In the improved embodiment releasing the handle and placing the plate at an angle locks the lifting apparatus and the partition in its raised position. In the alternative embodiment described above, the spring-biased stop member 134 is squeezed to overcome the bias resulting from spring 136. Upon proper positioning of the upper link and rachet arm 122 to leverage the partition 18 to the desired height, the spring-biased stop member 134 is released. This results in spring-biased stop member end 154 being biased into position against one of the shoulders serrated surface portion shoulders 152 of the serrated surface portion 138 of the upper link and rachet arm 122, thereby locking the partition 18 in its raised position.

The apparatus 110 is released and the supported partition is lowered only when the spring-biased stop member 134 is moved against the bias of the spring 136. Otherwise the weight of the partition is supported by the apparatus 110.

Figure 10:
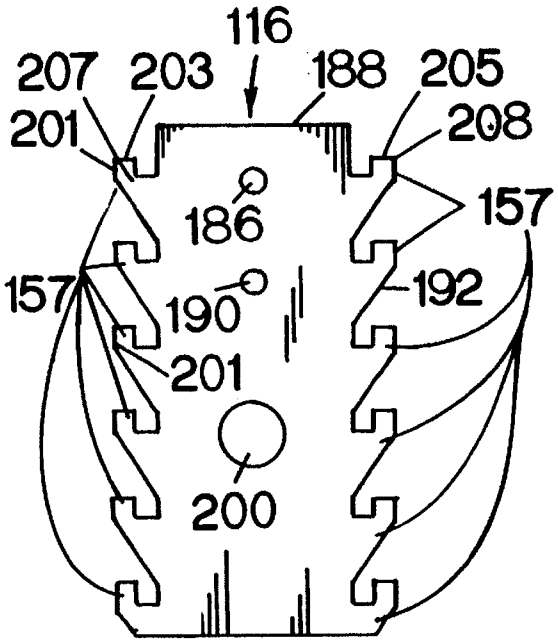

FIG. 10 illustrates one preferred bracket 116 having six upwardly directed bracket extensions 157 with squared corners on each side. Three holes 186, 190, and 200 are located along a vertical centerline of this embodiment of the bracket.

A centerline of a preferred embodiment of the bracket 116 is located approximately 1.5 inches from outside edges 201 of the extensions 157. A center portion of the topmost hole 186 is approximately 0.625 in. from the bracket's top edge 188 and has a diameter of approximately 9/32nds of an inch. Another hole 190 has the same approximate diameter and is located approximately 1.25 in. below the topmost hole 186. A center portion of the third hole 200 is located approximately 1.765 inches below the middle hole and has a diameter of approximately 0.75 in.

Upwardly directed bracket extensions 157 are approximately 1 inch apart with an upper edge 203 and 205 of a first extension 207 approximately 0.375 in. from a top edge 188 of the bracket 156. Bottom edges of extensions 192 slope upward in a straight line to the outer edge 201 of the extension. A preferred embodiment of this bracket is approximately 3 in. wide and approximately 6 in. long.

Figure 11:
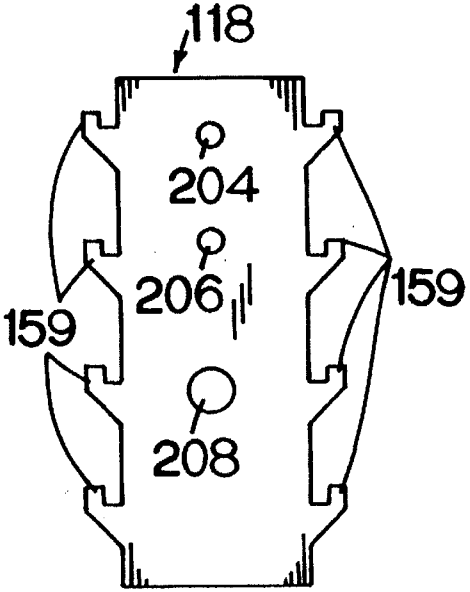

FIG. 11 illustrates another preferred embodiment of a bracket 118 of the present invention, similar to the one in FIG. 10 except that it only has four upwardly directed extensions 159 on each side. The extensions are approximately 1.5 in. apart. A plurality of holes 204, 206, 208 are configured in the same manner as in FIG. 10 except that the largest hole has a diameter of 0.5 inches.

Figure 12:
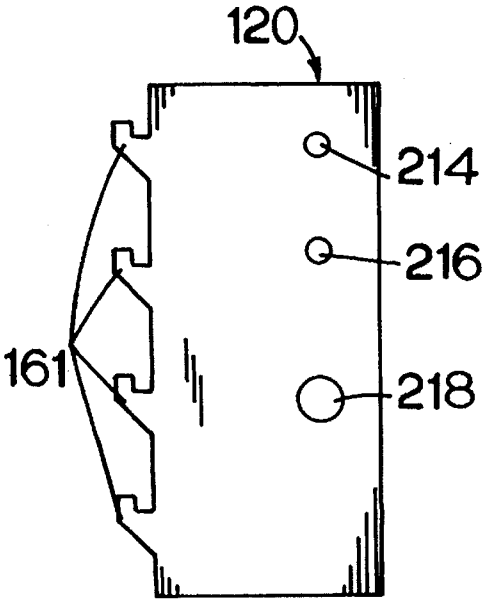
FIGS. 10–19 illustrate a variety of lift brackets suitable for use with any of the illustrated and described embodiments of the invention.

FIG. 12 illustrates another preferred embodiment of a bracket 120 of the present invention. The illustrated bracket includes four bracket extensions 161 on one side of the bracket 120. The extensions are approximately 1.5 inches apart.

Overall, the bracket 120 is approximately 6 in. long and approximately 3 in. wide. Bracket 120 includes three holes 214, 216, 218 with centers that lie along a line approximately 0.5 inches from the side without extensions. The largest hole 218 has a diameter of 0.5 inches. Otherwise the holes are configured as described in FIG. 10.

Figure 13:
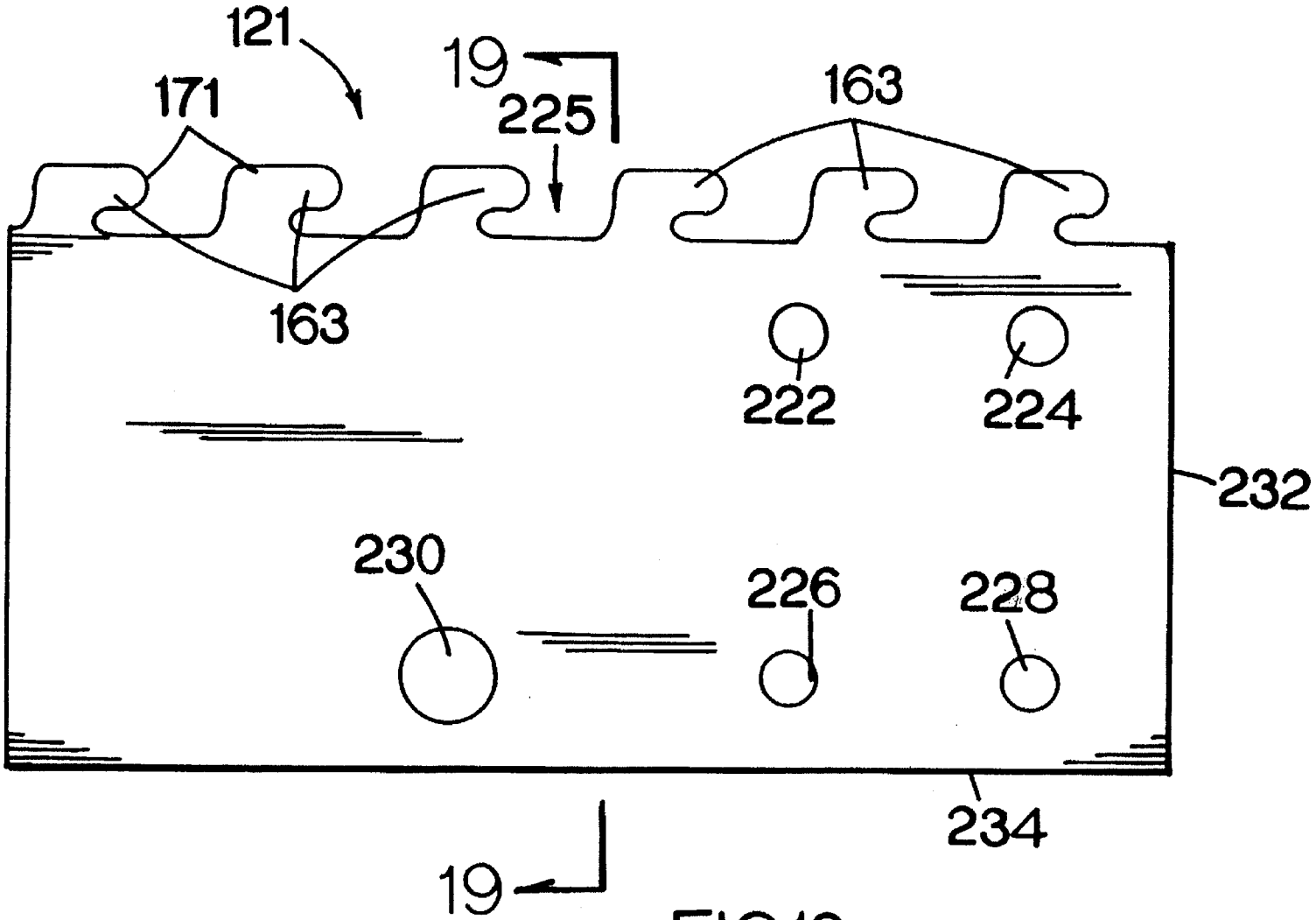

FIG. 13 is another preferred embodiment 121 of a lifting bracket in accordance with the present invention. A side 225 of the bracket 121 has six upwardly directed bracket extensions 163 with rounded corners 171 as illustrated in the drawings.

In one preferred embodiment the extensions 163 are approximately 1.0 in. apart. and 0.5626 in. wide. The bracket 121 is overall approximately 6 in. long, 2.5625 in. wide and 0.135 in. thick as illustrated in the section view FIG. 19.

An opposite side 234 is straight. As can be seen from the drawings, the bracket 121 is generally flat and otherwise rectangular with five holes 222, 224, 226, 228, 230 for attaching it to the lifting apparatus. Four holes 222, 224, 228, 230 have a diameter of approximately 9/32nds of an inch and form the corners of a square with sides approximately 1.25 in. long between the centers of the holes.

The square portion lies approximately 0.68 inches from the top edge 232 and approximately 0.5 inches from the inside edge 234 with its sides parallel to the top sides and inside edge of the bracket. The center of a larger hole 230 lies approximately 1.765 in from the left bottom hole in the square.

Figure 17:
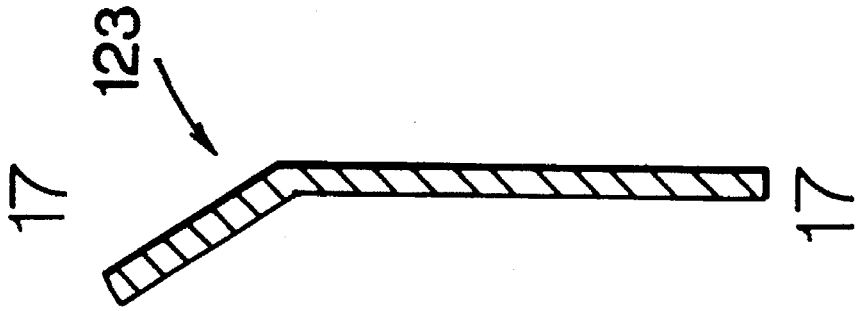
Figure 14:
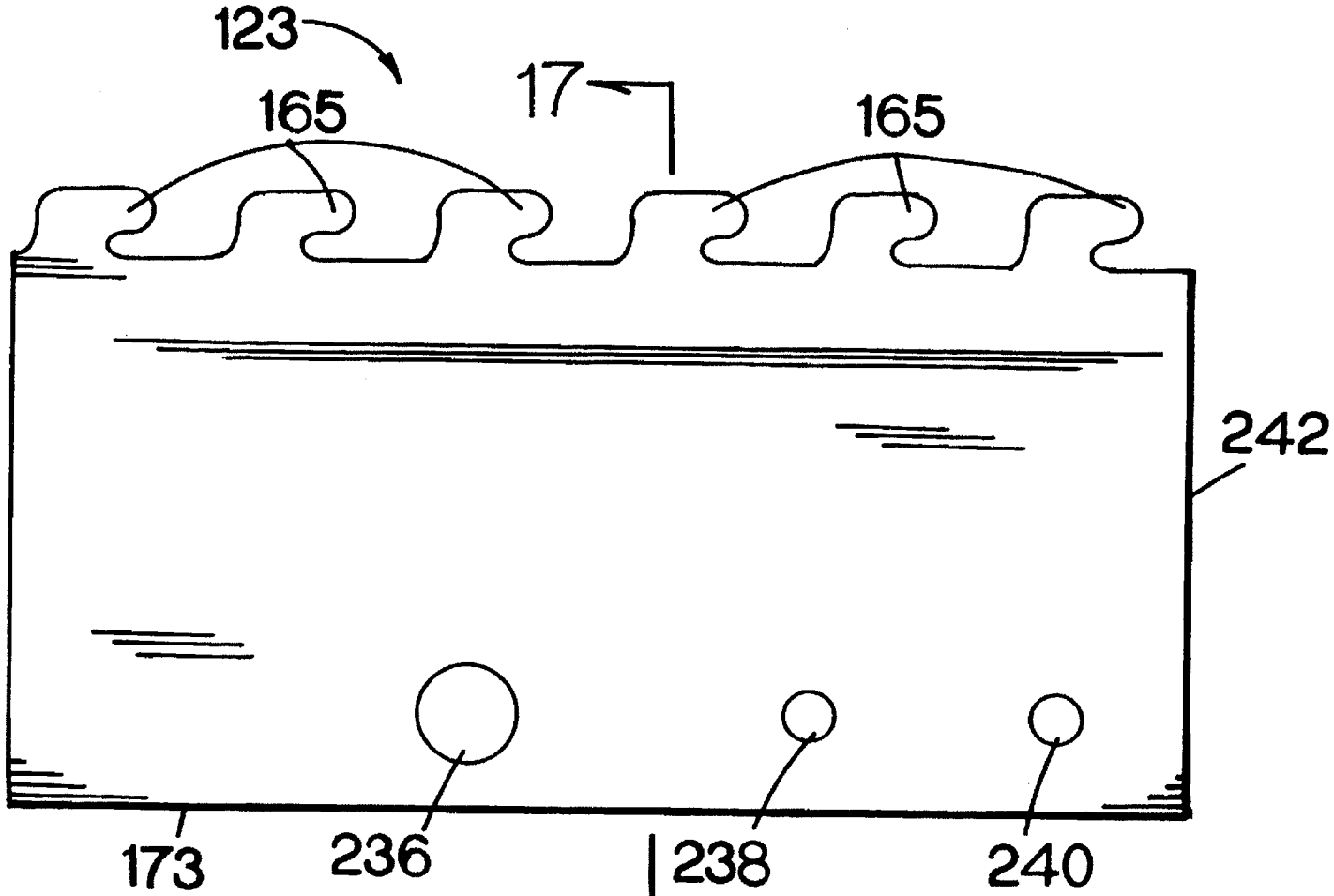

In FIG. 14 a lifting bracket 123 illustrated as having a bend of approximately 31° on the side with the upwardly directed extensions, as illustrated in FIG. 17. Bracket 123 has three holes 236, 238, and 240 located in a straight line near an inside edge 173 of the bracket 123.

The width of the bracket 123 is approximately 2.5626 in. The bracket is cut long enough to be that wide after bending it. The bracket is otherwise flat and configured like the one in FIG. 13.

Figure 18:
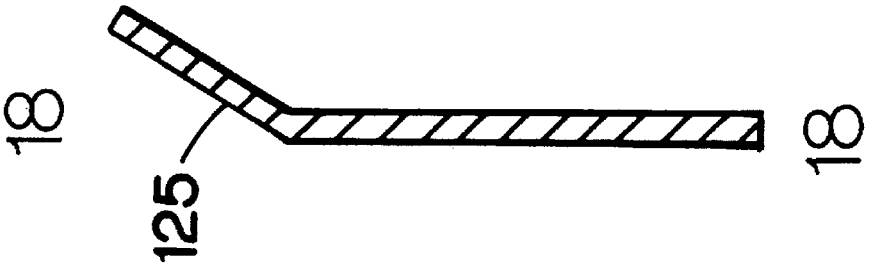
Figure 15:
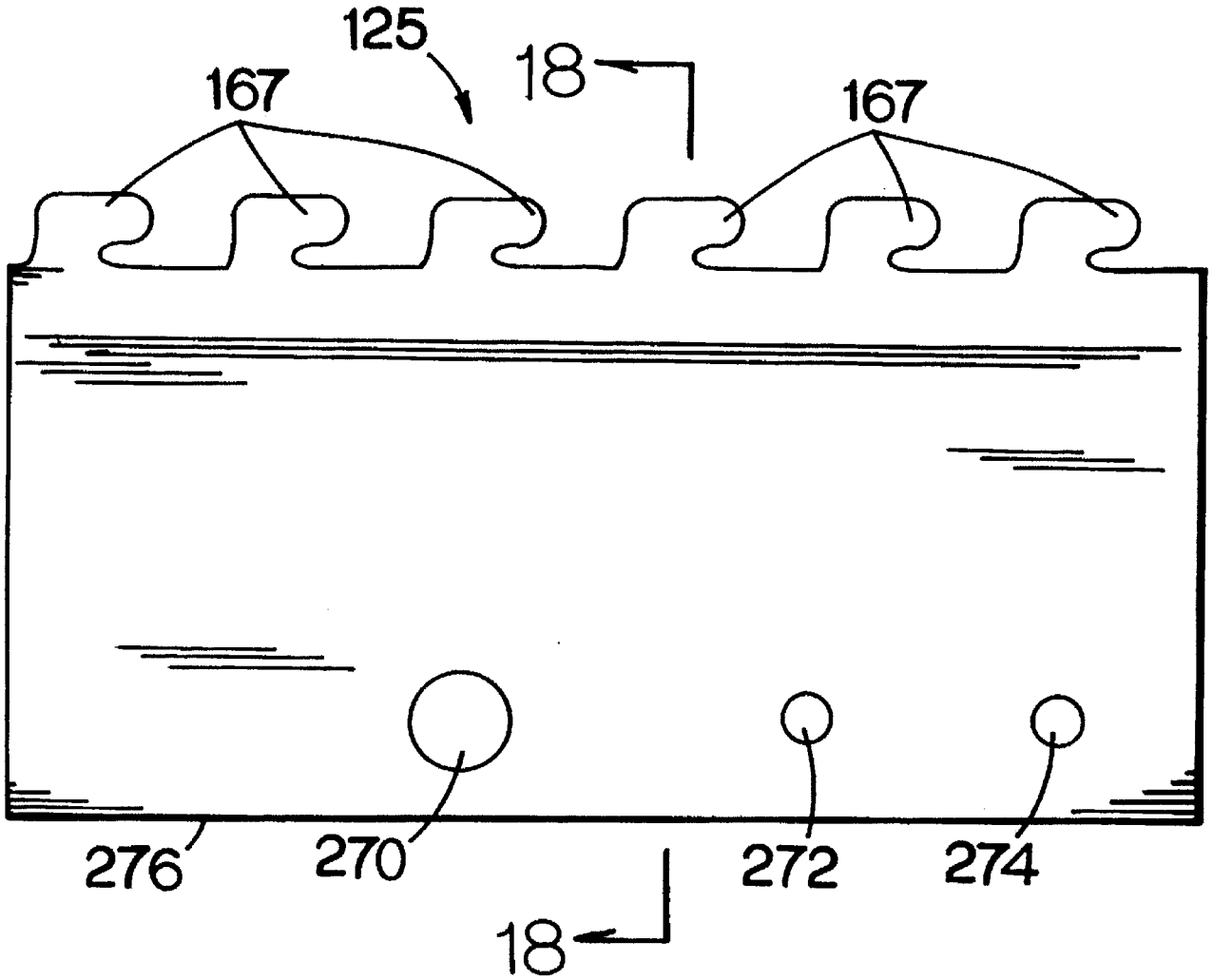

In FIG. 15 a lifting bracket 125 illustrated as having a bend of approximately 31° on the side with the upwardly directed extensions in the opposite direction as the bracket in FIGS. 14 and 17, as illustrated in FIG. 18. Bracket 125 has three holes 270, 272, and 274 located in a straight line near an inside edge 276 of the bracket 125.

The width of a preferred embodiment of the bracket 125 is approximately 2.5625 in. The bracket is cut long enough to be that wide after bending it. The bracket is otherwise flat and configured like the one in FIG. 13.

Figure 16:
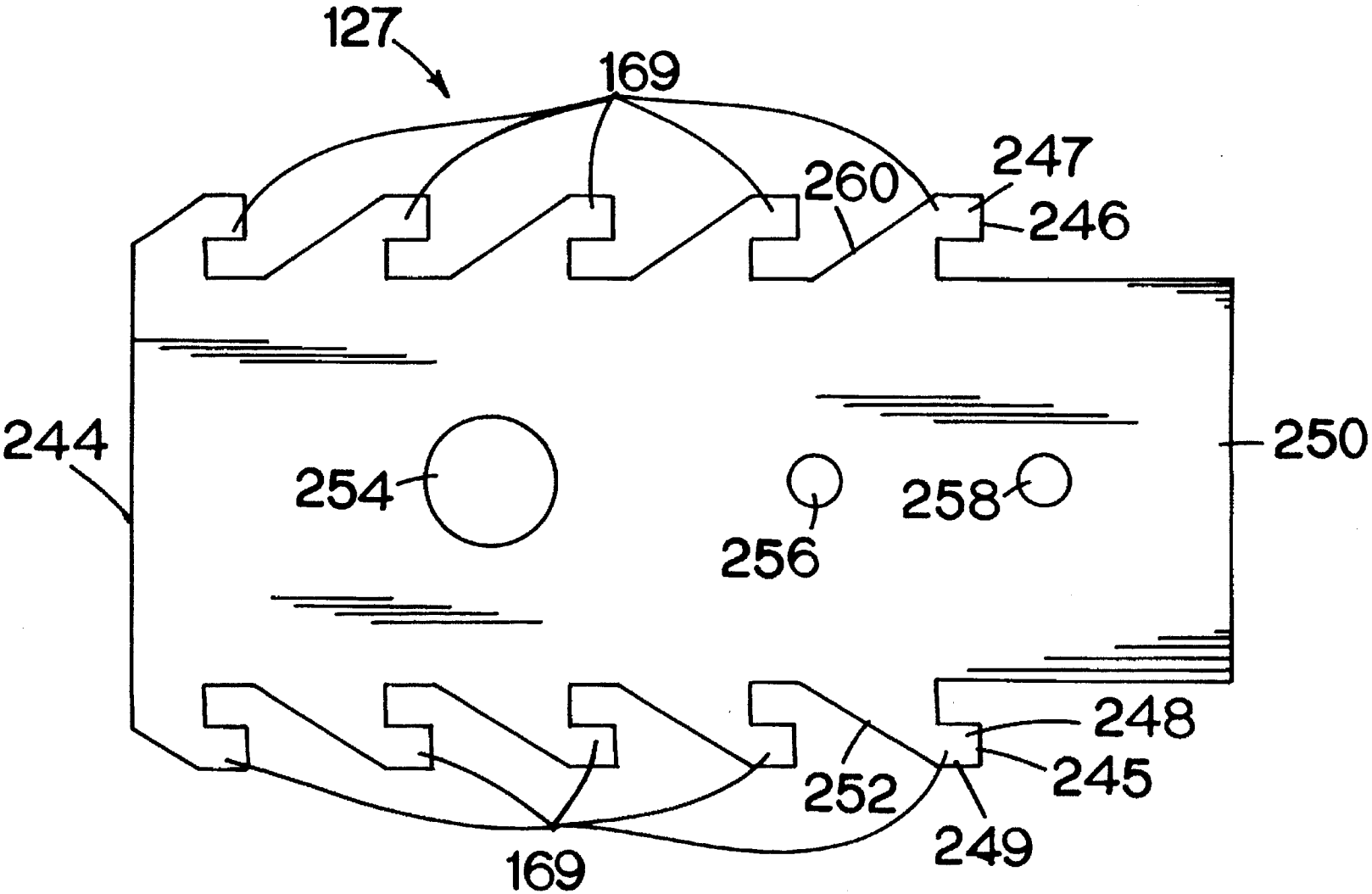
Figure 20:
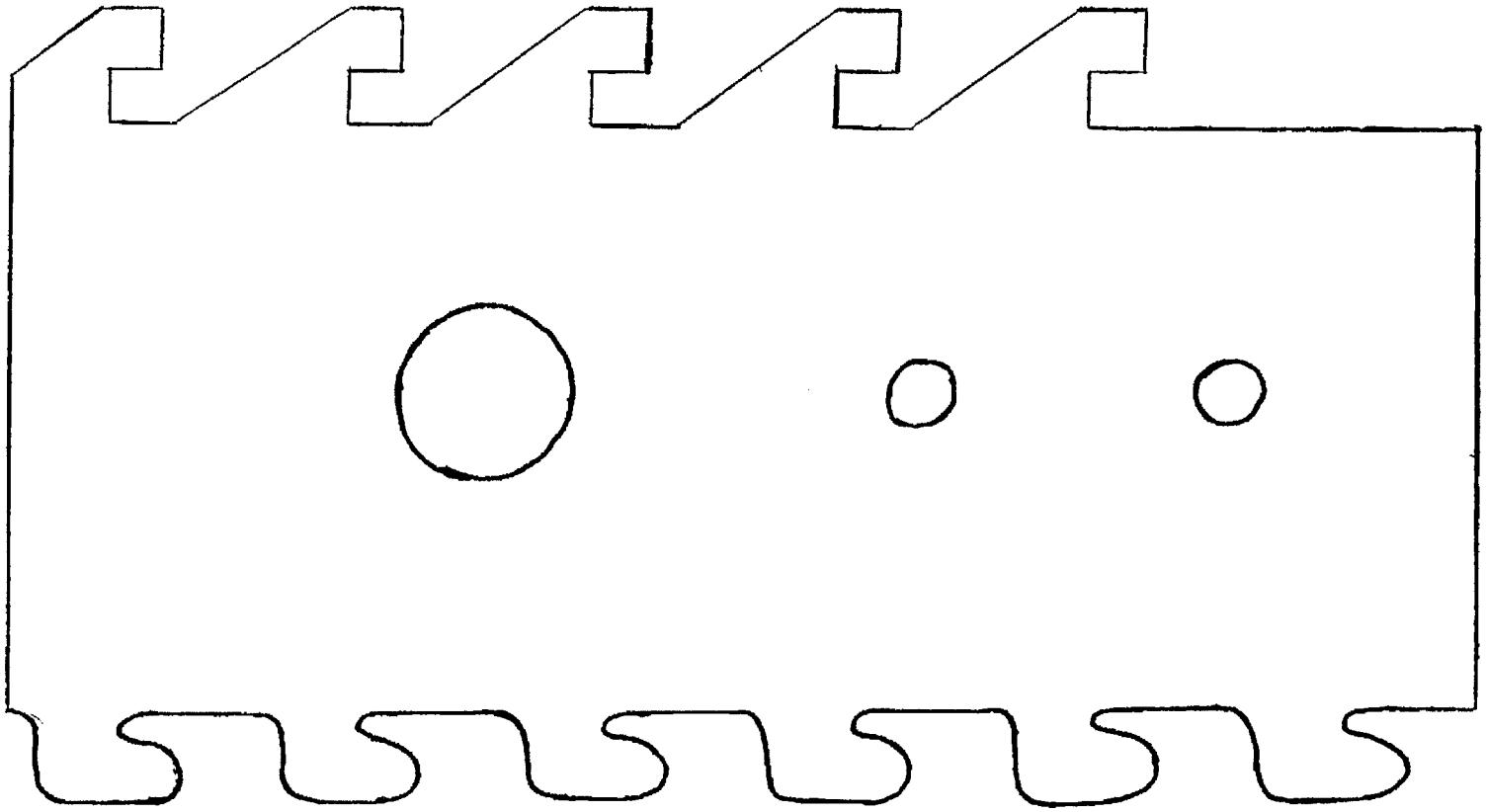
FIG. 20 illustrates a lift bracket having both extensions and opposite extension with different configurations.

FIG. 16 discloses five upwardly directed bracket extensions 169 on both sides of a flat lifting bracket 127. The extensions sit near a bottom portion 244 of the bracket 127 and approximately 1 in. apart.

Tip portions 245 and 247 of the topmost bracket extensions, 246 and 248 are approximately 1.375 in. from top portion 250 of the bracket 127. Bottom sides 252 and 260 of the bracket extensions 169 slope upward from the main body of the bracket at an angle.

The bracket 127 has three holes 254, 256, and 258 whose centers are located approximately 1.625 in. from outer edge 249 of the bracket extension 248. The hole 254 is approximately 1.765 in. from the hole 256.

The hole 258 is approximately 1.25 in from the center hole 256. The bracket 127 has a maximum thickness of approximately 0.135 inches.

The hole size and locations of the foregoing brackets may be modified to suit other bolt or pin arrangements. Similarly, bracket size and configuration is also variable.

FIG. 17 is the view of FIG. 14 taken from section 17—17. It reveals a bend in the bracket 123 near the bracket extensions.

FIG. 18 is the view of FIG. 15 taken from section 18—18. It reveals a bend in the opposite direction of FIG. 17.

Figure 19:
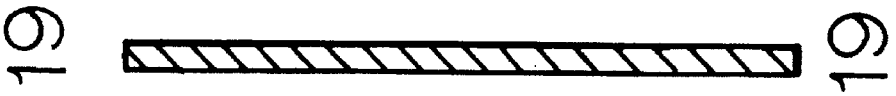

FIG. 19 is the side view of the bracket 121 designated by section 19—19 on FIG. 13.

The existing flooring is removed (if present) and new flooring is installed. The removal and installation is accomplished without disconnecting and removing the partition. The locking mechanism is released and the partition lowered. The bracket is removed and the lifting apparatus is moved to the next work area. As each new work area is ready the lifting apparatus is moved and connected to the adjacent partition or other furnishing and raised.

In a preferred embodiment the improved lifting apparatus 110 the foot/pedestal support 112 includes a base 158 approximately 7 inches by 3 inches and ⅜ inch thick. A ⅛ inch wall thickness, 1½ inch square pedestal tube 160 substantially centered on the base 158 receives an adjustable support member 162. As already described, the adjustable pedestal supports the lifting apparatus and brackets away from the partition, thereby allowing both floor covering removal and replacement directly underneath the raised partition.

The adjustable support member 162 includes a plurality of adjustment holes 164. There are preferably five holes, 1 inch center to center. A pin or member (not shown) inserted through an opening 166 in the pedestal tube 160 and the appropriate adjustment hole 164 provides for vertical adjustment of the lifting apparatus 110.

A forked member 168 fits in and is welded in place in the opening in the end of the adjustable support member 162. The forked member includes a solid insert 170 that fits into the end of the adjustable support member 162 and a pair of parallel forked extensions 172 that are drilled for pivotally receiving the yoke 126.

The apparatus comprises members that either pivot or slide relative to each other. The pivoting end of the upper link and rachet arm 122 is forked similar to the forked member 168 and the vertical link member 128 pivots within the forked portion of the receiving end of the upper link and rachet arm 122. The pivoting members are attached with suitable nut, bolt and washer combinations.

The brackets include openings for fastener combinations extending through the intermediate link member 130. In this way the brackets are retained on the intermediate link member 130.

The slide lock mechanism and its operation comprises an interaction between a serrated surface 174 and a spring-biased stop member 134. The serrated surface portion shoulders 152 include sliding surfaces 176 and stop surfaces 178.

In a preferred embodiment the sliding surfaces are orientated at approximately 30° from the surface of the upper link and rachet arm 122. The stop surfaces 178 form a right angle with the sliding surfaces 176.

The slide lock mechanism 114 is preferably formed from two square tube members 180 and 182. A slot 184 formed in the adjacent, welded walls of the two tube members allows the spring-biased member end 154 to contact the serrated surface 174.

From the foregoing description those skilled in the art will appreciate that all of the objects of the present invention are realized. The lifting apparatus allows the lifting of sections of partitions, for example, which it will be recognized will increase the rate at which the flooring removal and/or installation can be accomplished since the furnishings effectively remain in place during the work. The resulting time and labor savings promotes an efficient use of time and labor.

As the brackets can be changed, the lifting apparatus is adaptable for lifting furnishings of practically any design once a bracket with complementary extensions is designed. The offset support 28 effectively moves the lifting apparatus out of the work area and out of the way of the work to be done. The lifting apparatus is portable and, with a variety of brackets, can be taken to any location along with the appropriate brackets and used as disclosed in the foregoing specification and illustrated in the accompanying drawings.

The present invention is adapted to provide an improved lifting apparatus wherein the lifting bracket has two operable sides so that if one side of the bracket is damaged, it can be reversed, and work can continue with a minimum amount of delay.

It will be understood that the present invention provides an improved lifting apparatus constructed with a spring-biased locking mechanism for ease of use and a link member arranged and constructed with a revised and improved arm arrangement providing additional mechanical advantage incorporated into the easy to manufacture, assemble, and use tool.

The improvement uses a pivoting four-bar linkage and a sliding four-bar linkage which share a common, vertically adjustable fourth link. Additionally, the improved bracket is constructed with engaging and lifting members on more than one side of the bracket. These improvements provide a lifting tool that is easy to use and readily adapted for a quick change of brackets when different style partitions need to be lifted or if a bracket breaks or bends out of shape on only one side.

While specific embodiments have been shown and described, many variations are possible. The particular shape of the members and the lifting brackets including all dimensions may be changed as desired to suit the furnishings and the work space or area with which it is used.

The configuration and dimensions of the lifting bracket with its extensions and slots may vary although a preferred embodiment and additional improved embodiments are depicted for use with a variety of partitions. In another version of the partition a decorative flexible closure 58 is included. The flexible or other decorative closures will not impede the insertion of the bracket extensions as previously described.

Additional bracket embodiments 121, 123, 125, and 127 are illustrated in the drawings. In one embodiment, as illustrated in FIG. 17, a plurality of bracket extensions extend at an angle from the relatively planar plate. In a preferred embodiment, this angle is approximately 31° and the extensions can extend from either side of the plate.

Having described the invention in detail, those skilled in the art will appreciate that modifications may be made of the invention without departing from its spirit. Therefore, it is not intended that the scope of the invention be limited to the specific embodiment illustrated and described. Rather, it is intended that the scope of this invention be determined by the appended claims and their equivalents.

What is claimed is:

1. A lifting apparatus for raising furnishings, particularly suitable for use during removal and installation of floor covering, comprising:

a support member for supporting the lifting apparatus at a distance from a work area, the support member including a generally vertical link member supported on a supporting foot member;

a leveraging assembly for a controlled raising and lowering of an item of furnishing, the leveraging assembly including one four-bar linkage including pivoting link members and another four-bar linkage including pivoting and sliding link members, the one and the other four-bar linkages having at least one common link member including a common stationary link member further including the generally vertical link member;

a furnishing engaging member carried by the one pivoting four-bar linkage;

the other four-bar linkage including an upper link member and a lower control arm link member connected for relative sliding movement by a sliding locking link member, the sliding locking link member comprising a spring-biased stop member, an associated spring for biasing the spring-biased stop member, and one or the other of the upper link member and the lower control arm link member having at least one serration for receiving the spring-biased stop member when the spring-biased stop member is in a biased position, thereby substantially locking the lifting apparatus in a locked position until the stop member is removed from the receiving serration.

2. A lifting apparatus as set forth in claim 1 wherein the support member further comprises a pedestal tube rigidly attached to the supporting foot member, the pedestal tube receiving the generally vertical link member.

3. A lifting apparatus as set forth in claim 2 wherein the generally vertical link member has a plurality of adjustment holes and the pedestal tube has an opening, at least one of the plurality of adjustment holes of the generally vertical link member capable of being aligned with the opening of the pedestal tube such that a pin member can be received through both the opening and the at least one of the plurality of adjustment holes.

4. A lifting apparatus as set forth in claim 1 wherein the one four-bar linkage includes one link member for supporting the furnishing engaging member.

5. A lifting apparatus as set forth in claim 1 wherein the one four-bar linkage and the other four-bar linkage include both the common stationary link member and a common pivoting link member pivoting relative to the common stationary link member.

6. A lifting apparatus as set forth in claim 5 wherein the serration is located on the common pivoting link member.

7. A lifting apparatus as set forth in claim 5 wherein the common pivoting link member comprises the upper link member pivoting relative to the generally vertical link member.

8. A lifting apparatus as set forth in claim 1 wherein the at least one common link member of the one and the other four-bar linkages further comprises a common pivoting link member further comprising the upper link member.

9. A lifting apparatus for raising furnishings, particularly suitable for use during removal and installation of floor covering, comprising: a foot member and an adjustable vertical support member, the foot member supporting the lifting apparatus at a distance from a furnishing and an associated work area, the adjustable vertical support member further comprising a pedestal tube rigidly attached to the foot member, the pedestal tube capable of adjustably receiving a generally vertical link member such that the lifting apparatus can be vertically adjusted;

a leveraging assembly for a controlled raising and lowering of an item of furnishing, the leveraging assembly including one four-bar linkage including pivoting link members and another four-bar linkage including pivoting and sliding link members, the one and the other four-bar linkages having at least one common link member including a common stationary link member further including the generally vertical link member;

a furnishing engaging bracket, the furnishing engaging bracket attached to one link member of the pivoting four-bar linkage by an attachment connection so as to be removable and interchangeable with another furnishing engaging bracket; and a sliding lock mechanism link member of the other four-bar linkage for maintaining the lifting apparatus in a desired position, the sliding lock mechanism link member capable of sliding relative to the leveraging assembly an upper link member and pivoting relative to a lower control arm link member, the sliding lock mechanism link member being released and restrained by a release lever, whereby the release lever is biased ill a restraining position in which an end of the release lever engages a serrated portion of the upper link member to maintain the lifting apparatus in the desired position.

10. The lifting apparatus as set forth in claim 9 wherein the release lever is biased using a spring mechanism.

11. The lifting apparatus as set forth in claim 9 wherein the furnishing engaging bracket further includes extensions extending from opposite sides of the furnishing engaging bracket, thereby allowing the furnishing engaging bracket to be removed, reversed and reattached in the event of breakage of one or more extensions.

12. The lifting apparatus as set forth in claim 9 wherein the furnishing engaging bracket includes a first plurality of extensions configured for insertion into receiving openings in the furnishing to be lifted, the furnishing engaging bracket further including a second plurality of extensions opposite the first plurality of extensions, the second plurality of extensions being of a different configuration than the first plurality of extensions.

13. A lifting apparatus as set forth in claim 9 wherein the generally vertical link member has a plurality of adjustment holes and the pedestal tube has an opening, at least one of the plurality of adjustment holes of the generally vertical link member capable of being aligned with the opening of the pedestal tube such that a pin member can be received through both the opening and the at least one of the plurality of adjustment holes.

14. A lifting apparatus as set forth in claim 9 wherein the one four-bar linkage and the other four-bar linkage include the common stationary link member and a common pivoting link member pivoting relative to the common stationary link member, a lifting fulcrum located at the pivot connection between the common station and link member and the common pivoting link member.

15. A lifting apparatus as set forth in claim 14 wherein the serration is located on the common pivoting link member.

16. A lifting apparatus as set forth in claim 14 wherein the common pivoting link member comprises the upper link member pivoting relative to the generally vertical link member.

17. A lifting apparatus as set forth in claim 9 wherein the at least one common link member of the one and the other four-bar linkages further comprises a common pivoting link member further comprising the upper link member.

18. A method of lifting or raising furnishings, particularly suitable for use during removal and installation of floor covering, comprising:

supporting a support member of a lifting apparatus at a distance from a work area proximate an item of furnishing;

engaging the item of furnishing with an engaging member carried by the lifting apparatus;

raising and lowering an item of furnishing by operating a combination pivoting four-bar linkage and pivoting and sliding four-bar linkage with a common unmoving link and a common fulcrum;

locking the lifting apparatus in a locked position with a spring-biased rachet member.

19. A method as set forth in claim 18 including the further step of vertically adjusting the height of the lifting apparatus.

20. A method as set forth in claim 18 including the further step of vertically adjusting the height of the common link arm to adjust the height of the lifting apparatus.

21. A method as set forth in claim 18 including the further step of removing the engaging member from the lifting apparatus and reattaching another engaging member in its place.

* * * * *